US010415875B2

(12) United States Patent
Biotti et al.

(10) Patent No.: US 10,415,875 B2
(45) Date of Patent: Sep. 17, 2019

(54) SEALED CRISPER

(71) Applicant: WHIRLPOOL CORPORATION, Benton Harbor, MI (US)

(72) Inventors: Carolina Biotti, Comerio (IT); Rishikesh V. Kulkarni, St. Joseph, MI (US); Ilchung Park, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 183 days.

(21) Appl. No.: 15/226,950

(22) Filed: Aug. 3, 2016

(65) Prior Publication Data

US 2018/0038630 A1 Feb. 8, 2018

(51) Int. Cl.

| | |
|---|---|
| ***F25D 25/02*** | (2006.01) |
| ***F25D 11/02*** | (2006.01) |
| ***F25D 23/06*** | (2006.01) |
| ***F25D 23/08*** | (2006.01) |
| ***F25D 27/00*** | (2006.01) |

(52) U.S. Cl.

CPC ..... *F25D 25/025* (2013.01); *F25D 11/02* (2013.01); *F25D 23/066* (2013.01); *F25D 23/087* (2013.01); *F25D 27/00* (2013.01)

(58) Field of Classification Search

CPC .... F25D 25/025; F25D 23/087; F25D 23/066; F25D 11/02; F25D 27/00; F25D 17/065

USPC ..... 62/78

See application file for complete search history.

(56) References Cited

U.S. PATENT DOCUMENTS

| | | | | |
|---|---|---|---|---|
| 3,138,833 | A * | 6/1964 | Neuman | E05C 19/161 312/296 |
| 4,173,378 | A | 11/1979 | Hanson et al. | |
| 4,729,613 | A * | 3/1988 | Tromble | F25D 25/021 211/153 |
| 4,850,206 | A | 7/1989 | Larsen | |
| 5,044,704 | A | 9/1991 | Bussan et al. | |
| 5,641,217 | A | 6/1997 | Caruso et al. | |
| 7,665,327 | B2 | 2/2010 | Tunzi | |
| 7,914,094 | B2 | 3/2011 | Wood | |
| 8,979,621 | B2 | 3/2015 | Kelly et al. | |

(Continued)

FOREIGN PATENT DOCUMENTS

CA 2453683 A1 6/2005

OTHER PUBLICATIONS

European Patent Office, European Search Report for EP Application No. 17183796.6, dated Nov. 7, 2017, 9 pages.

*Primary Examiner* — Joseph F Trpisovsky

(74) *Attorney, Agent, or Firm* — Price Heneveld LLP

(57) ABSTRACT

A crisper assembly for a refrigerator has a crisper drawer defining a crisper cavity within the crisper drawer wherein the crisper drawer has a front wall, two side walls, a back wall having a top lip, and a bottom surface. A track assembly is coupled to the crisper drawer and configured to movably attach the crisper drawer to the crisper assembly and movably support the crisper drawer for movement in a first direction between a retracted position and an extended position within a refrigeration compartment. A front gasket is coupled to a first receiving flange wherein the front gasket has a bubble portion that contacts the front wall of the crisper drawer. A rear gasket is coupled to a second receiving flange where the rear gasket contacts the top lip and the back wall of the crisper drawer.

20 Claims, 10 Drawing Sheets

(56) References Cited

U.S. PATENT DOCUMENTS

| | | | | |
|---|---|---|---|---|
| 8,991,953 | B2 | 3/2015 | Lee et al. | |
| 2008/0265733 | A1* | 10/2008 | Hue | F25D 25/025 312/404 |
| 2013/0300276 | A1 | 11/2013 | Nuss | |
| 2014/0145579 | A1 | 5/2014 | Anderson et al. | |
| 2014/0300264 | A1* | 10/2014 | Park | F25D 25/025 312/404 |
| 2015/0323240 | A1* | 11/2015 | Klingshirn | F25D 17/062 62/186 |

* cited by examiner

SEALED CRISPER

FIELD OF THE DISCLOSURE

The present invention generally relates to a crisper assembly disposed within a refrigerator, and more specifically, to a crisper assembly that can better control the relative humidity therein.

BACKGROUND OF THE DISCLOSURE

A refrigerator, which generally includes a storage compartment and a cool air supply unit, is an appliance used to keep food and materials cool and/or fresh. The storage compartment is normally maintained within a temperature range required to keep the contents therein preserved. The storage compartment of such a refrigerator is normally provided with an open front portion on a cabinet. This open front portion is closed with a door to maintain the temperature within the refrigeration cabinet.

Provided in the refrigerator are a plurality of shelves to partition the storage compartment into a number of sections and many refrigerators have one or more crisper drawers to allow food to be accommodated in the inner spaces thereof. Crisper drawers in a refrigerator are normally disposed under a shelf but the open portion of the crisper drawer is frequently not sealed or completely closed off by the shelf. Standard crisper drawer designs are not able to maintain or regulate the humidity in the crisper drawer. A crisper assembly that maintains the desired relative humidity of the crisper drawer is desired.

SUMMARY

According to one aspect of the present disclosure, a crisper assembly for a refrigerator includes a crisper drawer defining a crisper cavity wherein the crisper drawer has a front wall, two side walls, a back wall having a top lip, and a bottom surface, a track assembly configured to moveably attach the crisper drawer to the crisper assembly and moveably support the crisper drawer for movement in a first direction between a retracted position and an extended position within a refrigeration compartment, a front gasket coupled to a first receiving flange wherein the front gasket has a bubble portion that contacts the front wall of the crisper drawer, and a rear gasket coupled to a second receiving flange wherein the rear gasket contacts the top lip and the back wall of the crisper drawer.

According to another aspect of the present disclosure, a refrigerator having a crisper assembly where the crisper assembly includes a crisper drawer defining a crisper cavity within the crisper drawer, a track assembly configured to moveably attach the crisper drawer to the crisper assembly and moveably support the crisper drawer for movement in a first direction between a retracted position and an extended position within a refrigeration compartment, a front gasket coupled to a first receiving flange wherein the front gasket contacts a front wall of the crisper drawer, and a rear gasket coupled to a second receiving flange wherein the rear gasket contacts a top lip and a back wall of the crisper drawer.

According to another aspect of the present disclosure, a method for maintaining a relative humidity in a crisper assembly for a refrigerator includes forming a crisper drawer defining a crisper cavity within the crisper drawer, coupling a track assembly configured to moveably attach the crisper drawer to the crisper assembly and moveably support the crisper drawer for movement in a first direction between a retracted position and an extended position within a refrigeration compartment, coupling a front gasket to a first receiving flange wherein the front gasket contacts a front wall of the crisper drawer, and coupling a rear gasket to a second receiving flange wherein the rear gasket contacts a back wall of the crisper drawer. The crisper drawer can maintain a relative humidity from about 70% to about 90%.

These and other features, advantages, and objects of the present device and method will be further understood and appreciated by those skilled in the art upon studying the following specification, claims, and appended drawings.

DETAILED DESCRIPTION OF EMBODIMENTS

Figure 1:
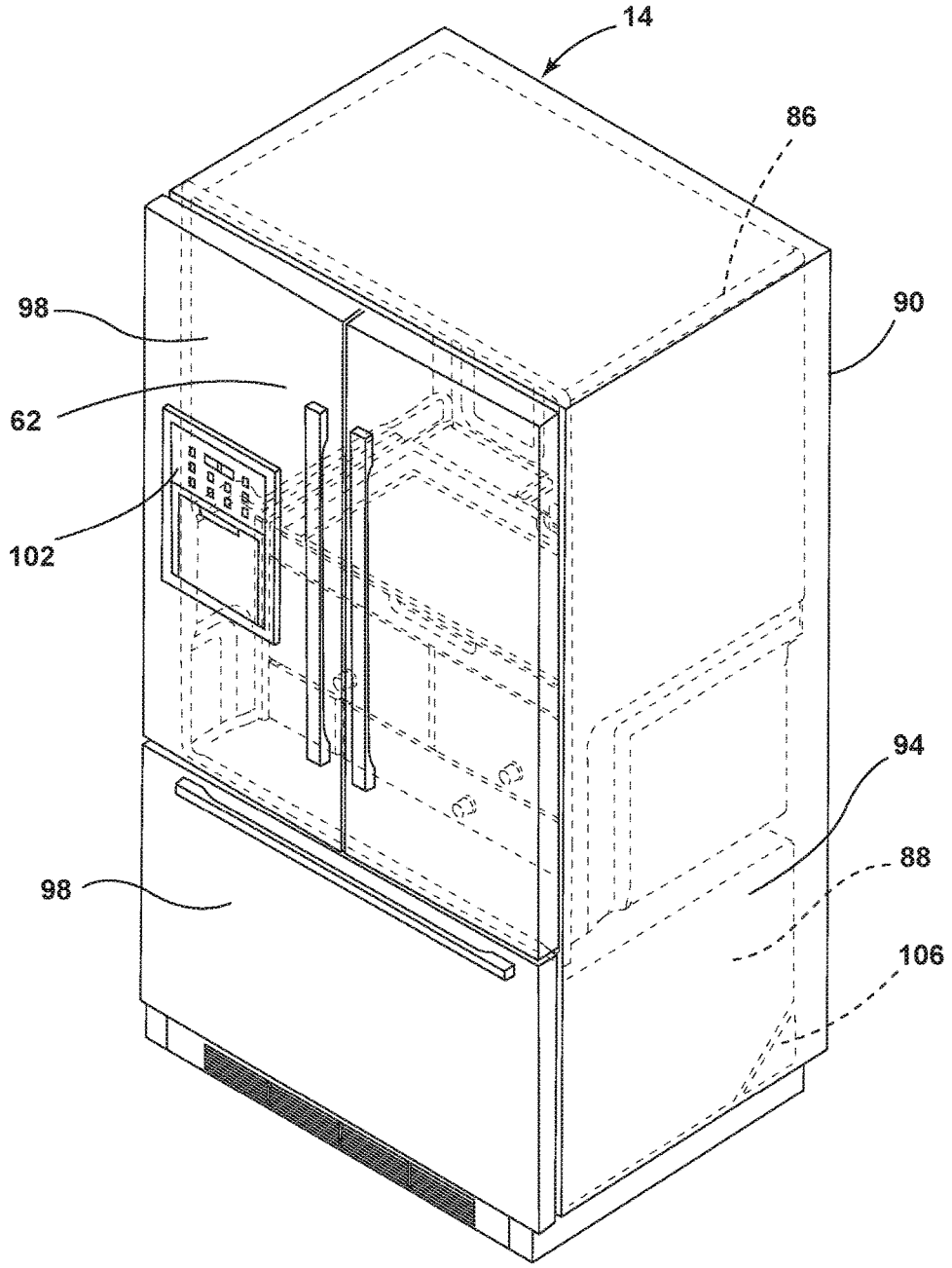
FIG. 1 is a front isometric view of a refrigerator according to one aspect of the present disclosure with several internal features shown in dashed lines.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," wherein used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-10D, reference numeral 10 generally designates a crisper assembly for a refrigerator 14. The crisper assembly 10 has a crisper drawer 18 defining a crisper cavity 22 within the crisper drawer 18 wherein the crisper drawer 18 has a front wall 26, two side walls 30, 34, a back wall 38 having a top lip 42, and a bottom surface 46. A track assembly 50 is coupled to the crisper drawer 18 and configured to movably attach the crisper drawer 18 to the crisper assembly 10 and movably support the crisper drawer 18 for movement in a first direction between a retracted position 54 and an extended position 58 within a refrigeration compartment 62. A front gasket 66 is coupled to a first receiving flange 70 wherein the front gasket 66 has a bubble portion 74 that contacts the front wall 26 of the crisper drawer 18. A rear gasket 78 is coupled to a second receiving flange 82 where the rear gasket 78 contacts the top lip 42 and the back wall 38 of the crisper drawer 18.

Referring now to FIG. 1, the refrigerator 14 has a refrigeration liner 86 and a freezer liner 88 enclosed in a wrapper 90 to form a refrigeration compartment 62 and a freezer compartment 94. The refrigerator 14 has one or more appliance doors 98 which may allow the users of the refrigerator 14 to place and remove items from within the refrigeration compartment 62 and the freezer compartment 94. The refrigerator 14 is depicted as a French door bottom mount refrigerator, but it will be understood that this disclosure may equally be applied to freezers, walk in coolers and the like, without departing from the teachings provided herein. The appliance doors 98 may optionally include an ice/water dispensing unit 102.

Also shown in FIG. 1, a refrigeration system 106 cools the refrigeration compartment 62 and the freezer compartment 94. The refrigeration system 106 may be a known system including a compressor, condenser, expansion valve, evaporator, conduits, and other related components (not shown). Alternatively, the refrigeration system 106 may include thermoelectric components (not shown), or other suitable arrangements depending on the use.

Figure 2:
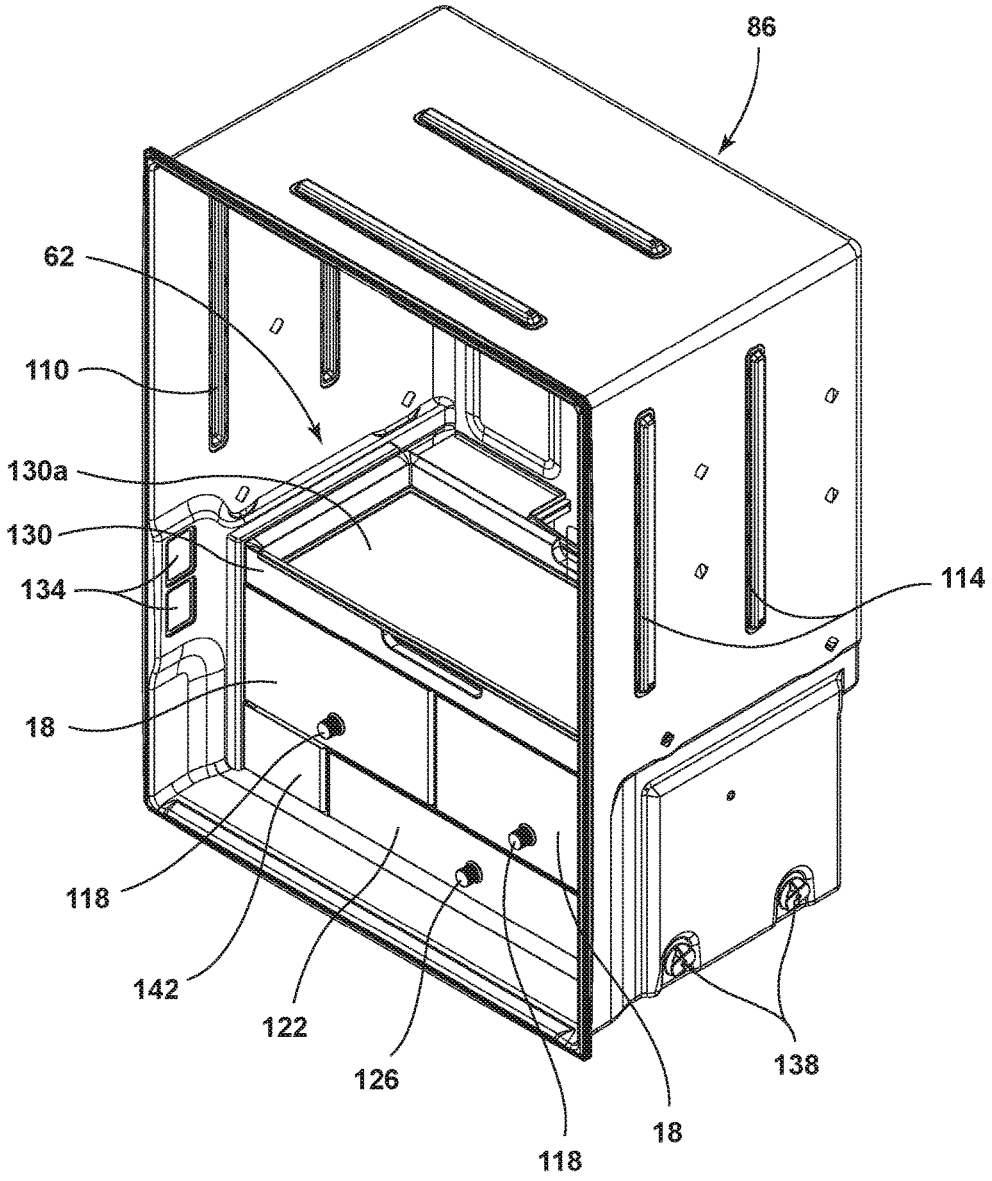
FIG. 2 is a front isometric view of the refrigeration liner according to one aspect of the present disclosure.

Referring now to FIG. 2, the refrigeration liner 86 has the crisper drawer 18 coupled to a crisper handle 118 covered with a shelf 130. The shelf 130 can be any variety of different shelves such as a platter shelf 130*a*. A LED light 110 is positioned in a LED compartment 114 of the refrigeration liner 86 to provide ambient light into the refrigeration compartment 62. An ice maker duct 134 is formed in the refrigeration liner 86 to allow ice from the freezer compartment 94 (FIG. 1) to be fed into the ice/water dispensing unit 102 (FIG. 1). A pantry drawer 122 coupled to a pantry drawer handle 126 is positioned beneath the crisper drawers 18 within the refrigeration liner 86. A refrigeration system cover 142 is optionally placed beneath the crisper drawers 18 in the refrigeration liner 86. A plurality of fastening devices 138 are coupled to the outside edge of the refrigeration liner 86 to couple the wrapper 90 (FIG. 1).

Figure 3:
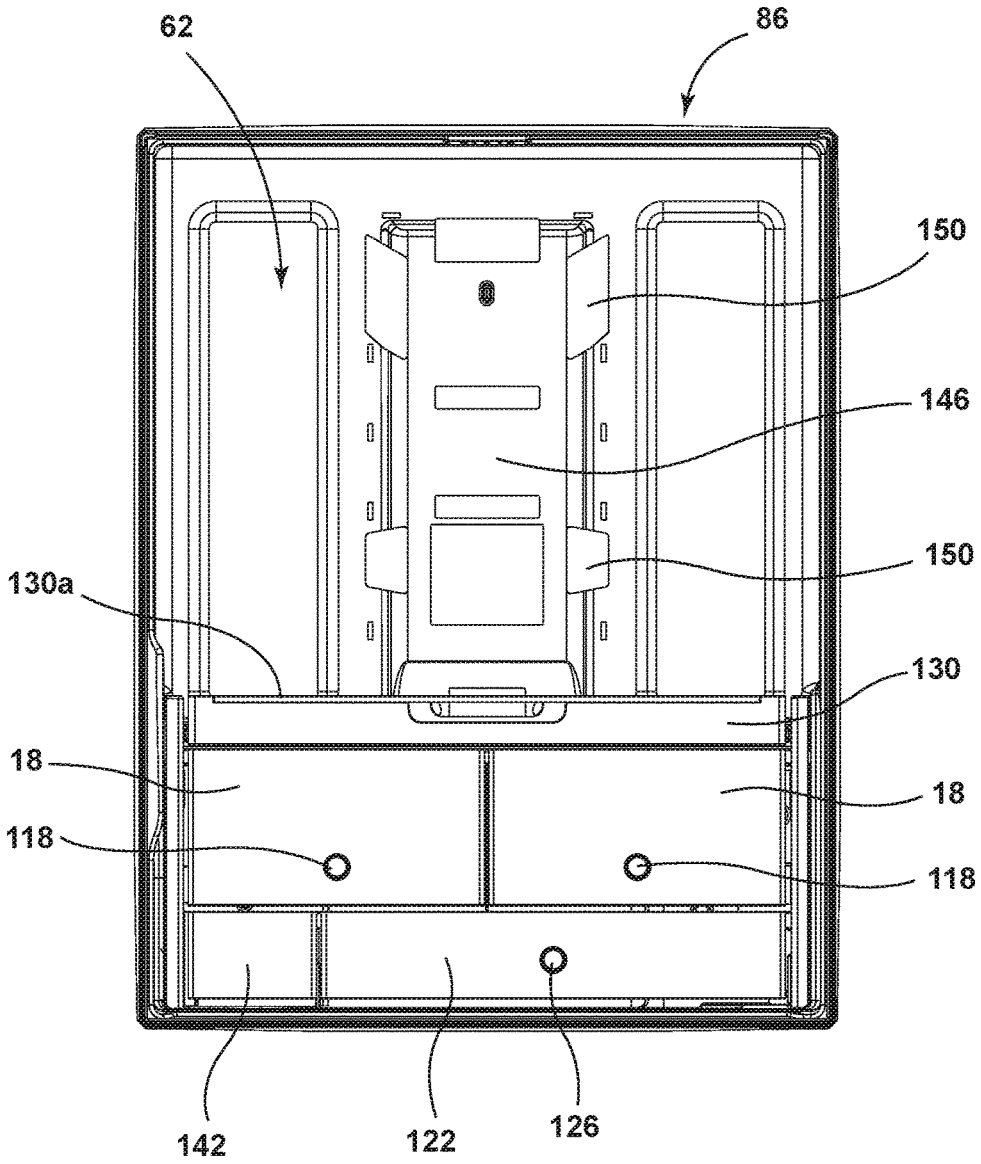
FIG. 3 is a front elevational view of the refrigeration liner according to one aspect of the present disclosure.
Figure 4:
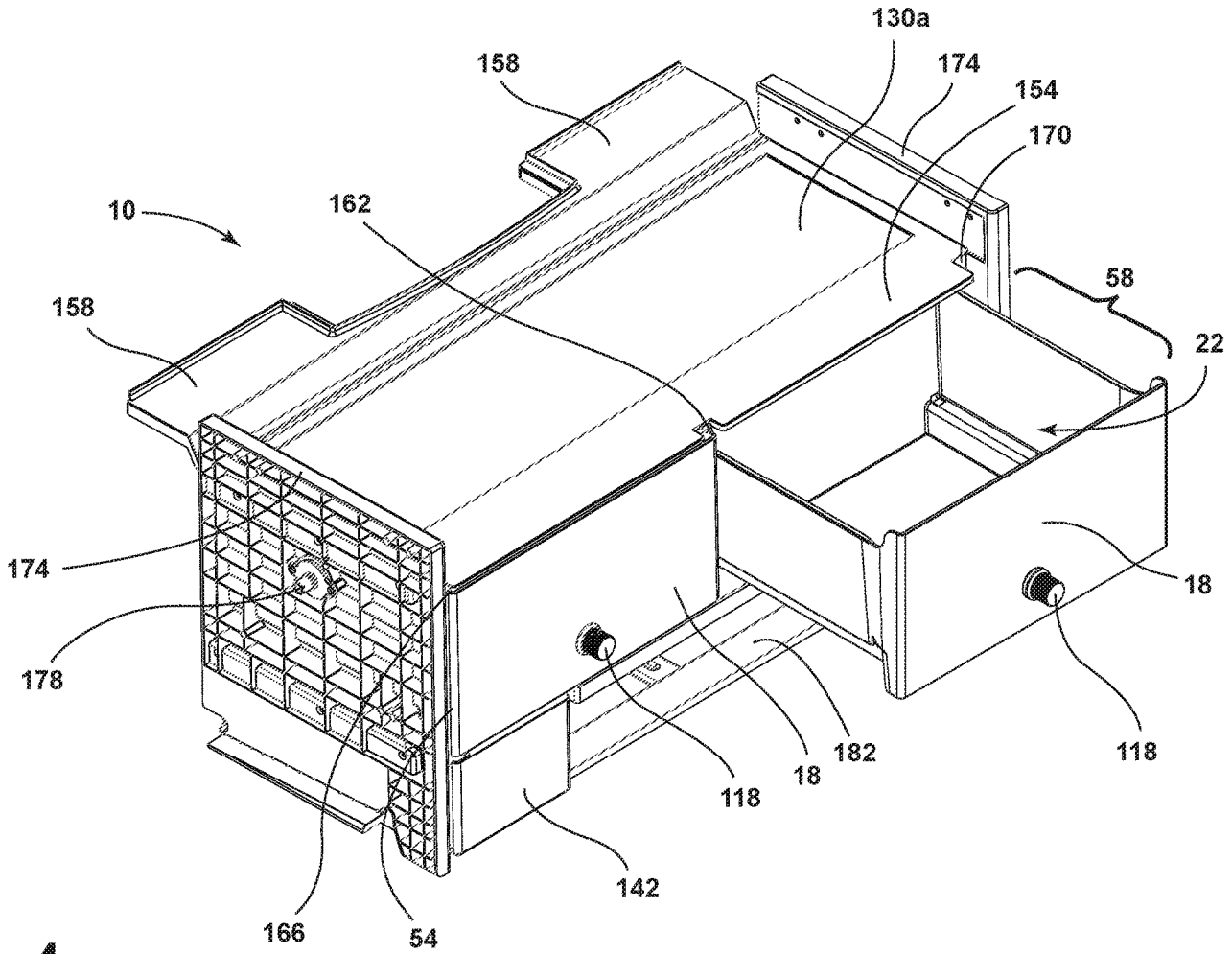
FIG. 4 is a front isometric view of a crisper assembly according to one aspect of the present disclosure.

Referring now to FIG. 3, a front elevational view of the refrigeration liner 86 shows an air tower 146 with one or more air outlets 150 to circulate cooled air throughout the refrigeration compartment 62. The crisper drawers 18 are coupled to the crisper handles 118 with the pantry drawer 122 and the refrigerator housing cover 142 positioned beneath and adjacent to the crisper drawers 18. The refrigeration liner 86 contains the shelf 130 positioned above the crisper drawer 18 enclosing the crisper cavity 22 (FIG. 4). The type of shelf 130 used to enclose the crisper cavity 22 of the crisper drawer 18 is non-limiting. In some embodiments, as shown in FIG. 3, the shelf 130 is a platter shelf 130*a*.

Referring now to FIG. 4, the crisper assembly 10 is shown with the crisper drawers 18 coupled to crisper handles 118 where the crisper drawers 18 are positioned underneath the platter shelf 130*a*. The platter shelf 130*a* has two rear shelf members 158 and has a platter shelf frame 154 with a center crisper edge cutout 162, a left crisper edge cutout 166, and a right crisper edge cutout 170. The crisper assembly 10 has a base support structure 182 as its bottom edge and has a support structure 174 with a fastener 178 on each side of the crisper assembly 10 to couple to the wrapper 90 (FIG. 1).

Figure 5:
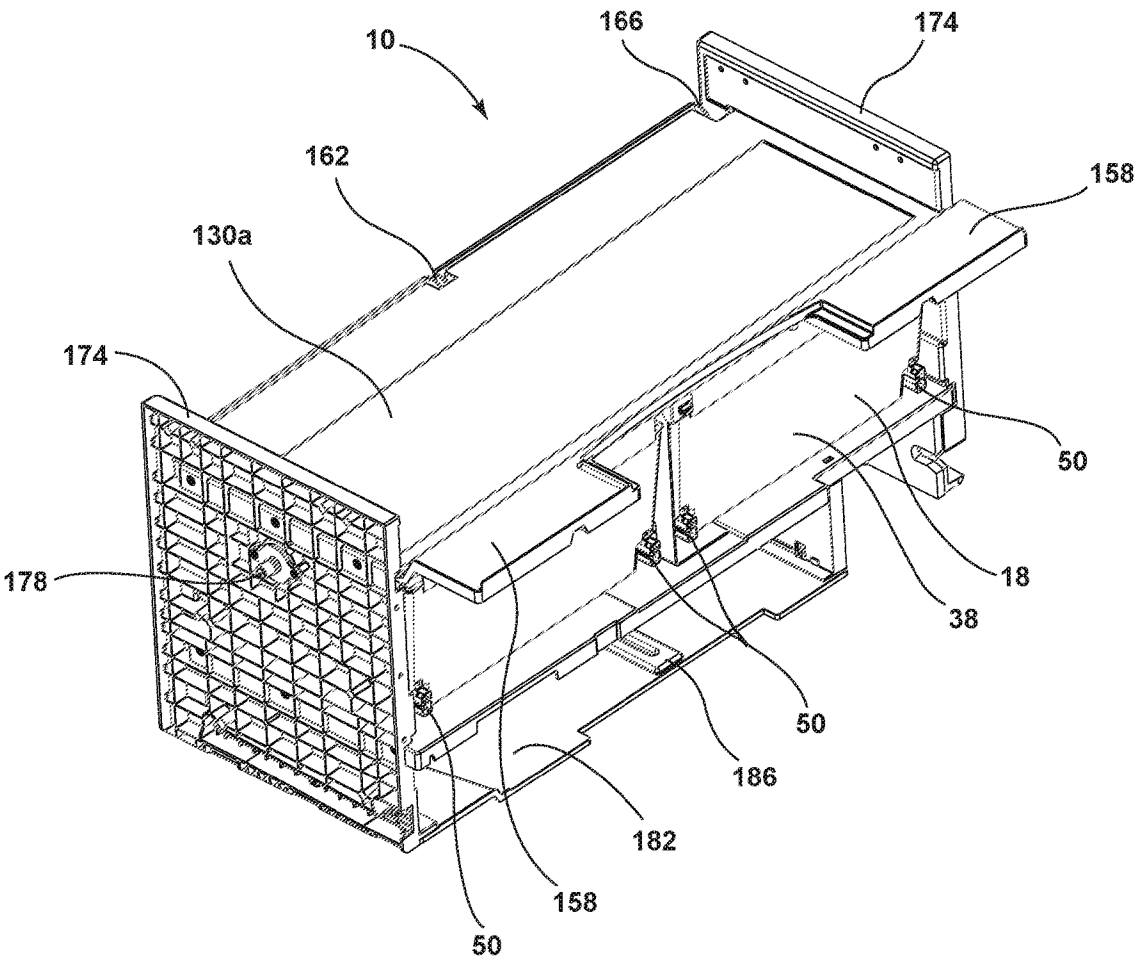
FIG. 5 is a rear isometric view of a crisper assembly according to one aspect of the present disclosure.

Referring now to FIG. 5, a rear isometric view of the crisper assembly 10 is shown with the platter shelf 130*a* having the center crisper edge cutout 162 and left crisper edge cutout 166 in combination with the rear shelf members 158. The sides of the crisper assembly 10 are made up of the support structure 174 with the fastener 178 positioned therein to couple to the wrapper 90 (FIG. 1) of the refrigeration compartment 62 (FIG. 1). The back wall 38 of the crisper drawer 18 is shown coupled to the track assembly 50. At the bottom of the crisper assembly 10 the base support structure 182 is coupled to an integrated cavity support 186 to further support the crisper assembly 10 in the wrapper 90 and refrigerator compartment 62.

Figure 6:
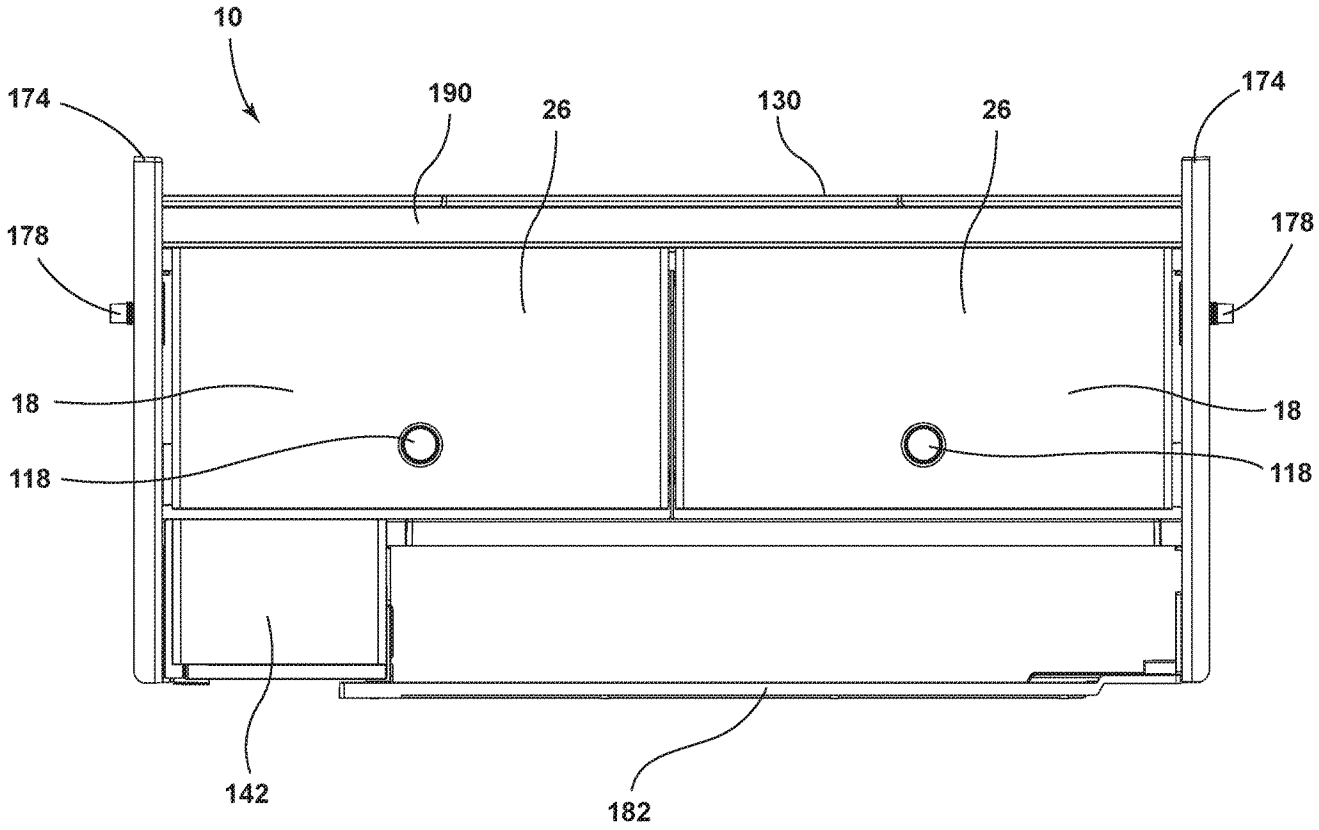
FIG. 6 is a front elevational view of a crisper assembly according to one aspect of the present disclosure.

Referring now to FIG. 6, a front elevational view of the crisper assembly 10 is shown with the crisper drawers 18 coupled to the crisper handles 118. The sides of the crisper assembly 10 have the support structure 174 and the fastener 178 that may be coupled to the wrapper 90 (FIG. 1) of the refrigeration compartment 62 (FIG. 1). The top of the crisper assembly 10 has the shelf 130 coupled to a front face 190 of the shelf 130 where the front face 190 is even with the front wall 26 of the crisper drawer 18 when closed. Below the crisper drawers 18 and at the bottom of the crisper assembly 10 is the refrigeration system cover 142 and the base support structure 182.

Figure 7:
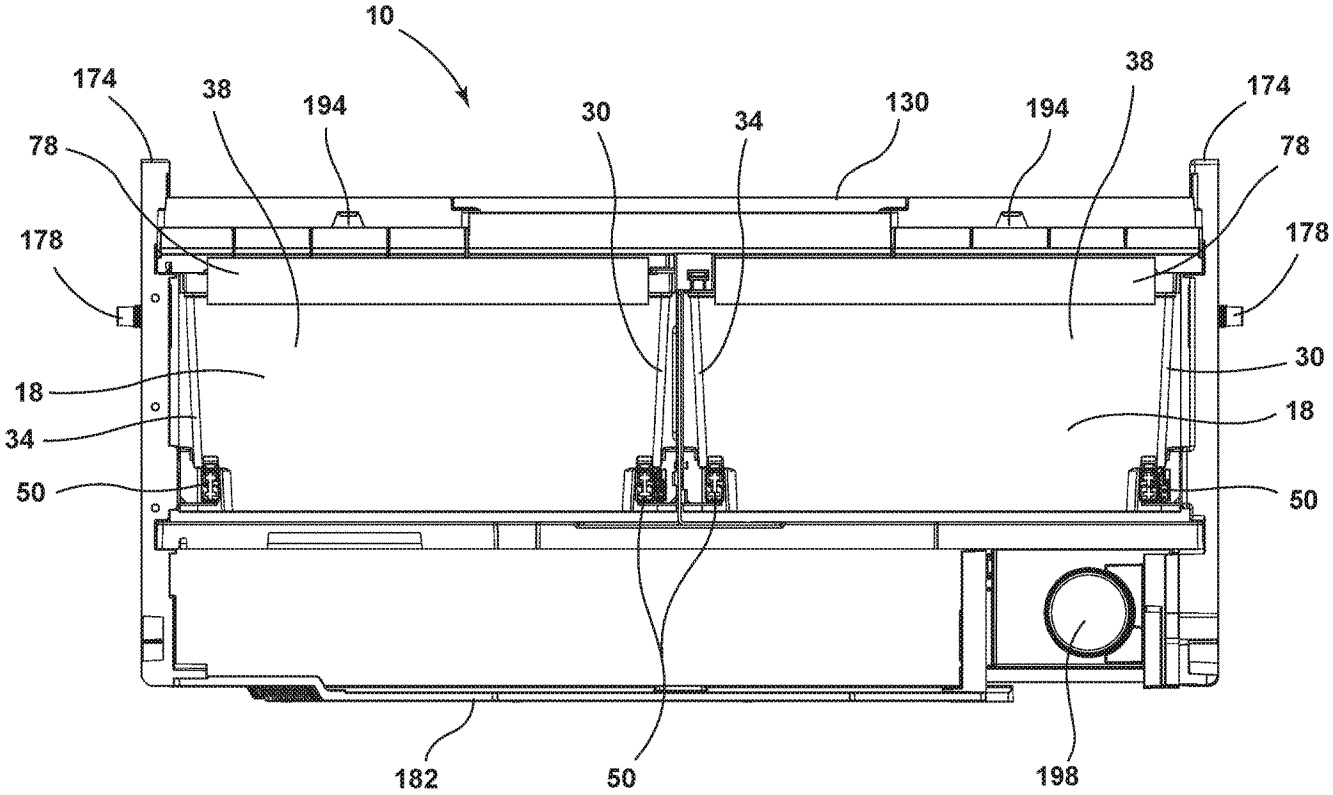
FIG. 7 is a rear elevational view of a crisper assembly according to one aspect of the present disclosure.

Referring now to FIG. 7, a back elevational view of the crisper assembly 10 is shown with the shelf 130 covering the crisper drawers 18 having the left crisper wall 30, the right crisper wall 34, and the back crisper wall 38. A rear shelf clip 194 is positioned on the shelf 130 to couple the crisper assembly 10 to the wrapper 90 (FIG. 1) of the refrigeration compartment 62 (FIG. 1). The crisper drawers 18 are mounted on the track assembly 50 where the top lip 42 (FIG. 9) of the back wall 38 is positioned against the rear gasket 78. At the bottom of the crisper assembly 10 the base support structure 182 and a compressor 198 are shown.

The use and contact of the front gasket 66 and the rear gasket 78 with the front wall 26 and the top lip 42 of the crisper drawer 18, respectively, can help control a relative humidity in the crisper drawer 18 when enclosed or closed in the crisper assembly 10. The term, "relative humidity," as used herein, is defined as the ratio of the partial pressure of water vapor to the equilibrium vapor pressure of water at a given temperature. In some embodiments, the crisper drawer 18 can maintain the relative humidity from about 70% to about 90%. In other embodiments, the crisper drawer 18 can maintain the relative humidity from about 80% to about 85%. The relative humidity in the crisper drawer 18 can be additionally varied by the type of produce stored in the crisper drawer 18. For example, some types of produce that are sensitive to the relative humidity of their storage environment are leafy vegetables, e.g. spinach and lettuce. In some embodiments, the crisper drawer 18 including the front gasket 66 and the rear gasket 78, may contain an amount of leafy vegetables, e.g. spinach and/or lettuce, without any packaging on the vegetable. In these embodiments, the leafy vegetables positioned in the crisper drawer 18 will have less than an 8% weight loss in five or fewer days. The weight loss was determined daily by weighing the spinach, lettuce and/or leafy vegetables and comparing it to the initial weight recorded. In other embodiments, an amount of leafy vegetables, e.g. spinach and/or lettuce, positioned in the crisper drawer 18 will have less than an 8% weight loss in ten or fewer days. In embodiments where the crisper drawer 18 can maintain the relative humidity from about 70% to about 90%, or from about 80% to about 85%, the crisper drawer 18 prevents a condensation of water in the crisper cavity 22. The terms, "prevented condensation of water," as used herein, means that no visually observable water accumulates on the walls 26, 30, 34, 38 of the closed crisper drawer 18 while the relative humidity is maintained from about 70% to about 90%, or from about 80% to about 85%.

Figure 8:
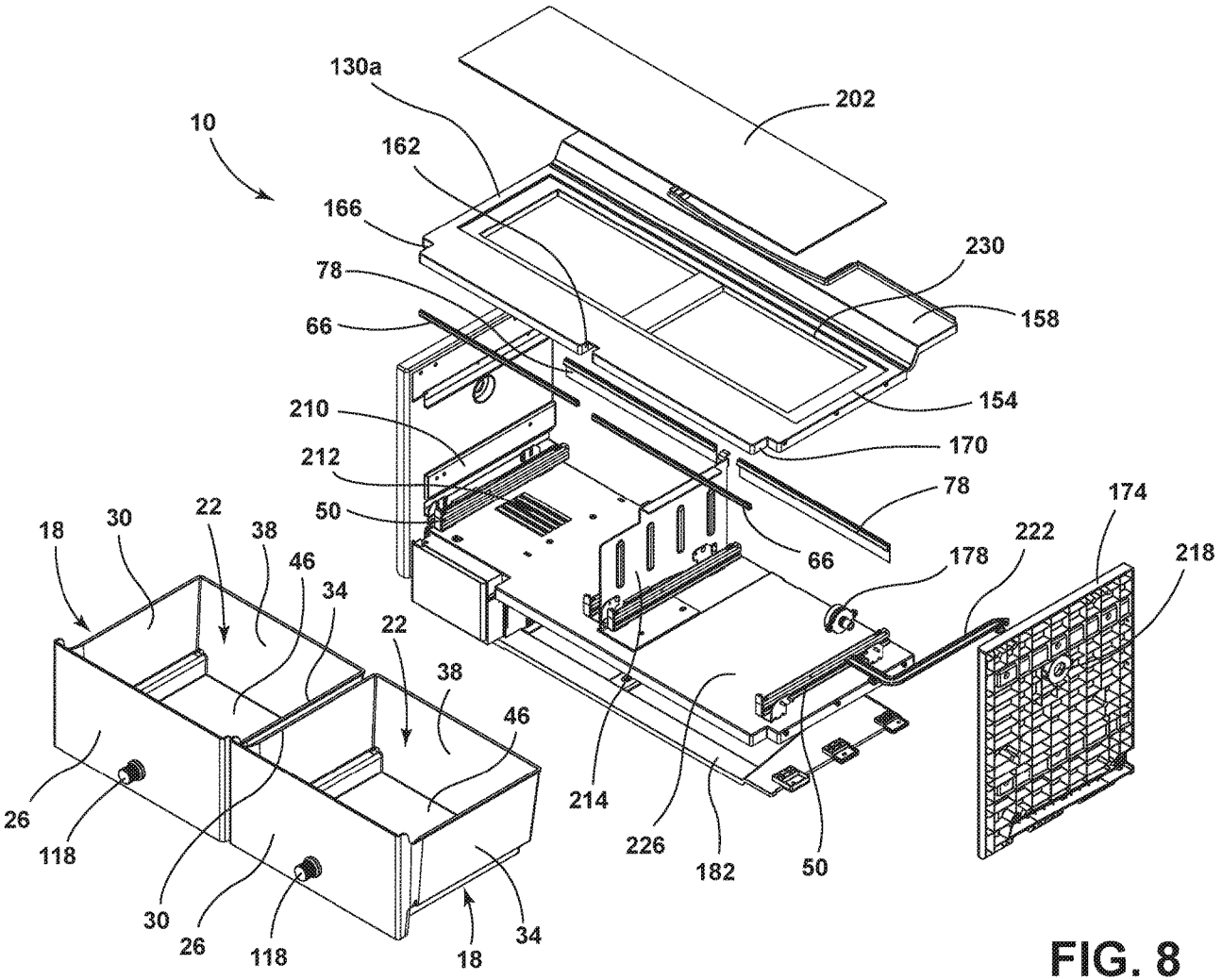
FIG. 8 is an exploded front isometric view of a crisper assembly according to one aspect of the present disclosure.

Referring now to FIG. 8, an exploded view of the crisper assembly 10 is shown. The crisper drawers 18 each have the front wall 26 coupled to the crisper handle 118, the left crisper wall 30, the right crisper wall 34, the back crisper wall 38, and the bottom crisper surface 46. Each crisper drawer 18 also has a track assembly channel 234 (FIG. 9) where the track assembly 50 is housed. The crisper drawer 18 defines the crisper cavity 22 where foodstuffs may be placed. In the embodiment shown, the platter shelf 130*a* has the platter shelf frame 154 enclosing a glass insert 202 and the center crisper edge cutout 162, the left crisper edge cutout 166, and the right crisper edge cutout 170, in addition to the rear shelf members 158. On the bottom of the platter shelf 130*a* is a first receiving flange 70 (FIG. 9) to be coupled to the front gasket 66 and a second receiving flange 82 (FIG. 9) to be coupled to the rear gasket 78. The crisper assembly 10 has the support structure 174 on the sides with a structure opening 218 centrally positioned to connect to a support member 222 and the fastener 178. A bottom assembly member 226 of the crisper assembly 10 has a center dividing wall 214 positioned centrally with the track assembly 50 coupled thereto. A vent 212 is positioned in the bottom assembly member 226. A mounting plate 210 is additionally coupled to the support structure 174. The base support structure 182 makes the bottom side of the crisper assembly 10.

Figure 9:
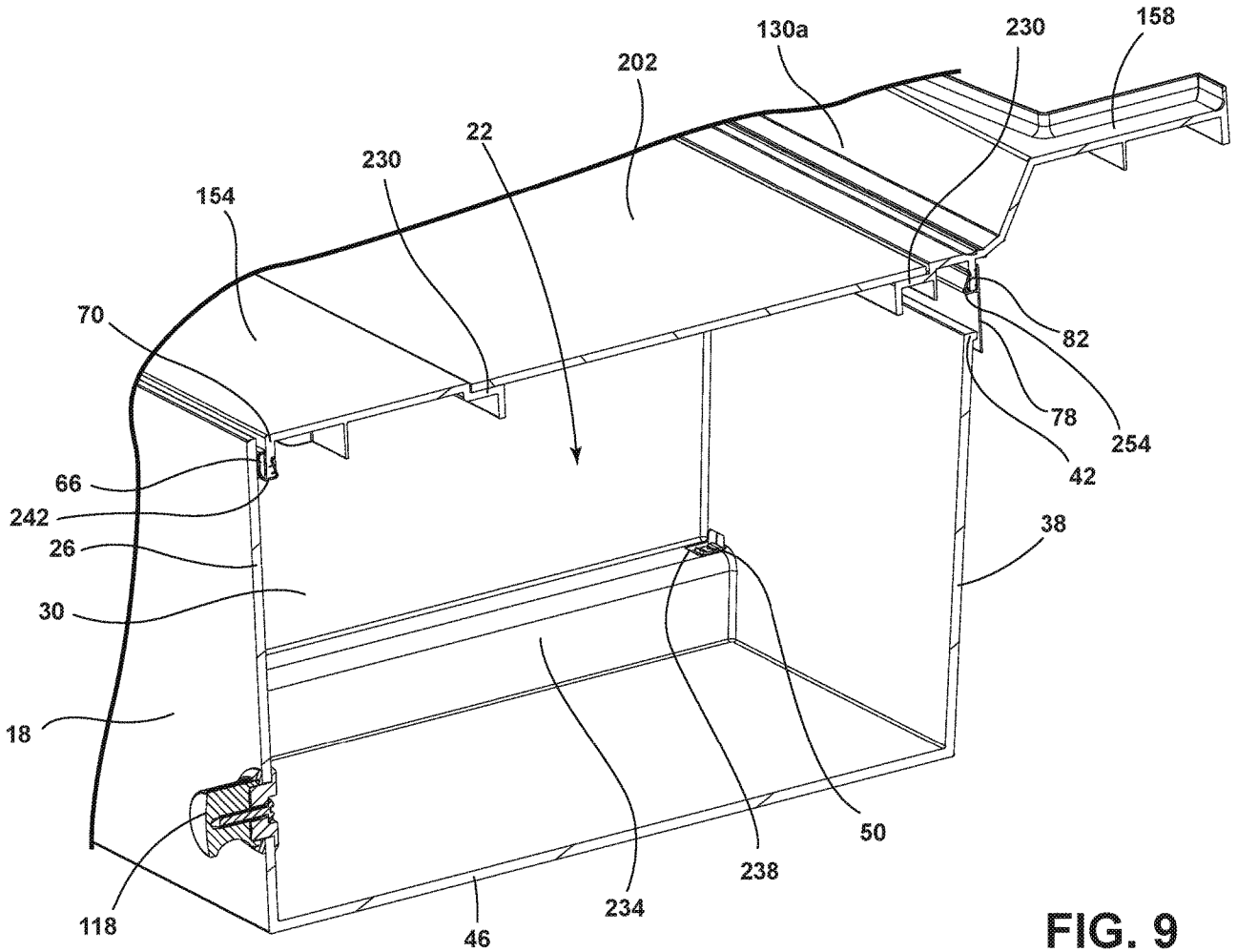
FIG. 9 is a partially schematic fragmentary cross-sectional view of a portion of the crisper assembly according to one aspect of the present disclosure.

Referring now to FIG. 9, a cross-sectional view of the crisper drawer 18 and the platter shelf 130*a* is shown. The crisper drawer 18 is shown with the front wall 26, the left wall 30, the back wall 38, and the track assembly channel 234 positioned along the long lower inside edge to mount the track assembly 50 through a channel opening 238. To form a top surface for the crisper drawer 18 and the crisper cavity 22, the platter shelf 130*a* is made of the platter shelf frame 154 and a glass receiving frame 230 to mount the glass insert 202. The platter shelf 130*a* additionally has the rear shelf member 158 and the first receiving flange 70 coupled to the front gasket 66 and the second receiving flange 82 coupled to the rear gasket 78. In some embodiments, the front gasket 66 has the first clip member 242 coupled to the first receiving flange 70 and the rear gasket 78 has the second clip member 254 coupled to the second receiving flange 82.

Figure 10C:
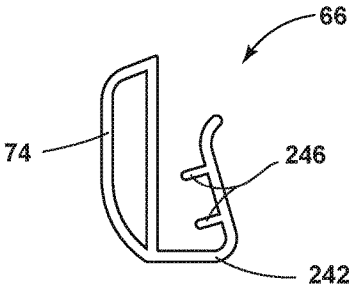
FIG. 10C is a partially schematic cross-sectional view of a portion of the front gasket shown in FIG. 10B according to one aspect of the present disclosure.
Figure 10D:
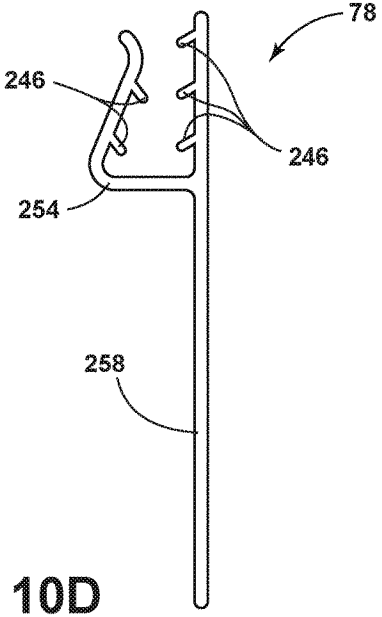
FIG. 10D is a partially schematic cross-sectional view of a portion of the rear gasket of the crisper assembly according to one aspect of the present disclosure.
Figure 10B:
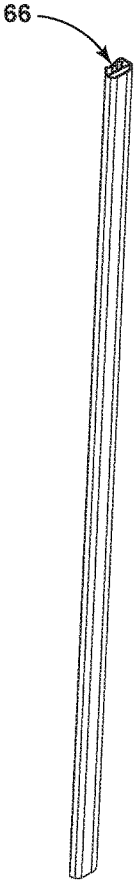
FIG. 10B is a top isometric view of a front gasket of the crisper assembly according to one aspect of the present disclosure.
Figure 10A:
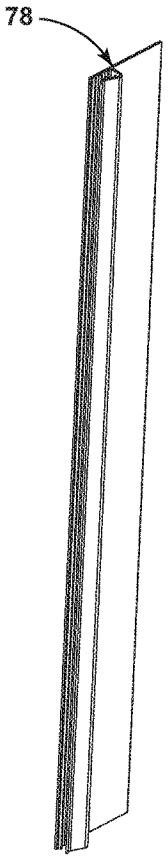
FIG. 10A is a top isometric view of a rear gasket according to one aspect of the present disclosure.

Referring now to FIGS. 10A-10D, FIG. 10A shows the rear gasket 78 and FIG. 10B shows the front gasket 66. FIG. 10C shows the cross-sectional view of the front gasket 66 and the bubble portion 74, one or more receiving fins 246, and a first clip member 242. FIG. 10D shows the rear gasket 78 having one or more receiving fins 246, a gasket edge 258, and a second clip member 254. In some embodiments, the front gasket 66 has the bubble portion 74 in contact with the front wall 26 (FIG. 8) of the crisper drawer 18 (FIG. 2) and the rear gasket 78 has the gasket edge 258 in contact with the top lip 42 (FIG. 9) and/or the back wall 38 (FIG. 8).

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A crisper assembly for a refrigerator, the crisper assembly comprising:

a shelf supported by first and second support structures, wherein the shelf includes first and second side cutouts and a center cutout;

a base support structure extending between the first and second support structures, wherein the base support structure is spaced apart from the shelf by the first and second support structures;

a glass receiving frame integrally formed with the shelf;

a glass insert positioned within the glass receiving frame;

a crisper drawer defining a crisper cavity wherein the crisper drawer comprises a front wall, two side walls, a back wall having a top lip, and a bottom surface;

a track assembly configured to moveably attach the crisper drawer to the crisper assembly and moveably support the crisper drawer for movement in a first direction between a retracted position and an extended position within a refrigeration compartment;

a front gasket coupled to a first receiving flange wherein the front gasket has a bubble portion having a linear side and a rounded side, wherein the rounded side is coupled to the linear side at first and second ends of the linear side, and further wherein the linear side is vertically aligned such that the rounded side contacts the front wall of the crisper drawer when the crisper drawer is in a closed position; and a rear gasket coupled to a second receiving flange wherein the rear gasket has a seal flap vertically positioned that contacts the top lip and/or the back wall of the crisper drawer.

2. The crisper assembly of claim 1 further comprising:

the shelf positioned above the crisper drawer enclosing the crisper cavity.

3. The crisper assembly of claim 2, wherein the shelf is a platter shelf.

4. The crisper assembly of claim 1, wherein the front gasket has a first clip member coupled to the first receiving flange.

5. The crisper assembly of claim 1, wherein the rear gasket has a second clip member coupled to the second receiving flange.

6. The crisper assembly of claim 1, wherein the crisper drawer can maintain a relative humidity from about 70% to about 90%.

7. The crisper assembly of claim 1, wherein the crisper drawer can maintain a relative humidity from about 80% to about 85%.

8. The crisper assembly of claim 1, wherein an amount of leafy vegetables positioned in the crisper drawer has less than an 8% weight loss in five or fewer days.

9. The crisper assembly of claim 1, wherein the rear gasket comprises a gasket edge in contact with the top lip and back wall of the crisper drawer.

10. The crisper assembly of claim 1, wherein the crisper drawer prevents a condensation of water in the crisper cavity.

11. A refrigerator having a crisper assembly, the crisper assembly comprising:

a crisper drawer defining a crisper cavity within the crisper drawer;

a track assembly configured to moveably attach the crisper drawer to the crisper assembly and moveably support the crisper drawer for movement in a first direction between a retracted position and an extended position within a refrigeration compartment;

a front gasket coupled to a first receiving flange wherein the front gasket includes a bubble portion having a linear side and a rounded side, wherein the rounded side is coupled to the linear side at first and second ends of the linear side, and further wherein the linear side is vertically aligned such that the rounded side contacts a front wall of the crisper drawer when the crisper drawer is in a closed position; and a rear gasket coupled to a second receiving flange wherein the rear gasket includes a seal flap vertically positioned that contacts a top lip and/or a back wall of the crisper drawer.

12. The refrigerator having a crisper assembly of claim 11 further comprising:

a shelf positioned above the crisper drawer enclosing the crisper cavity.

13. The refrigerator having a crisper assembly of claim 11, wherein the front gasket has a first clip member coupled to the first receiving flange.

14. The refrigerator having a crisper assembly of claim 11, wherein the rear gasket has a second clip member coupled to the second receiving flange.

15. The refrigerator having a crisper assembly of claim 11, wherein the crisper drawer can maintain a relative humidity from about 80% to about 85%.

16. The refrigerator having a crisper assembly of claim 11, wherein an amount of leafy vegetables positioned in the crisper drawer has less than an 8% weight loss in five or fewer days.

17. A method of constructing a crisper assembly that maintains a relative humidity within, the method comprising:

forming a crisper drawer defining a crisper cavity within the crisper drawer;

coupling a track assembly configured to moveably attach the crisper drawer to the crisper assembly and moveably support the crisper drawer for movement in a first direction between a retracted position and an extended position within a refrigeration compartment;

providing a front gasket that includes an elongated bubble portion positioned to extend upward along a first receiving flange when the front gasket is coupled to the crisper drawer;

coupling the front gasket to the first receiving flange such that a first receiving fin is positioned in contact with the first receiving flange, wherein the front gasket is positioned such that the bubble portion contacts a front wall of the crisper drawer when the crisper drawer is in a closed position; and coupling a rear gasket to a second receiving flange such that a second receiving fin of the rear gasket is positioned in contact with the second receiving flange, wherein the rear gasket includes a seal flap vertically positioned that contacts a top lip and/or a back wall of the crisper drawer, wherein the crisper drawer can maintain a relative humidity from about 70% to about 90%.

18. The method of claim 17, further comprising:

maintaining the relative humidity from about 80% to about 85% within the crisper drawer.

19. The method of claim 17, further comprising:

maintaining an 8% weight loss in an amount of leafy vegetables positioned in the crisper drawer in five or fewer days.

20. The method of claim 17, further comprising:

preventing a condensation of water in the crisper cavity of the crisper drawer.

* * * * *